US006450097B1

(12) United States Patent
Kistler et al.

(10) Patent No.: US 6,450,097 B1
(45) Date of Patent: Sep. 17, 2002

(54) METHOD OF REGULATING INKING WHEN PRINTING WITH A PRINTING MACHINE

(75) Inventors: Bernd Kistler, Eppingen; Nikolaus Pfeiffer, Heidelberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/546,418

(22) Filed: Apr. 10, 2000

(30) Foreign Application Priority Data

Apr. 10, 1999 (DE) ..... 199 15 804

(51) Int. Cl.[7] ..... B41F 1/54; B41F 31/02
(52) U.S. Cl. ..... 101/483; 101/365
(58) Field of Search ..... 101/349.1, 350.1, 101/148, 363–365, 483

(56) References Cited

U.S. PATENT DOCUMENTS

| | | | | |
|---|---|---|---|---|
| 3,835,777 A | * | 9/1974 | Krygeris | 101/350 |
| 4,210,078 A | * | 7/1980 | Greiner et al. | 101/136 |
| 4,649,502 A | * | 3/1987 | Keller et al. | 364/519 |
| 4,660,470 A | * | 4/1987 | Kramp et al. | 101/426 |
| 4,852,485 A | * | 8/1989 | Brunner | 101/211 |
| 4,975,862 A | | 12/1990 | Keller et al. | |
| 5,029,527 A | * | 7/1991 | Jeschke et al. | 101/365 |
| 5,568,769 A | | 10/1996 | Leuerer | |
| 5,835,626 A | | 11/1998 | Huber et al. | |

FOREIGN PATENT DOCUMENTS

| | | |
|---|---|---|
| DE | 44 12 601 A1 | 10/1995 |
| DE | 195 16 330 A1 | 11/1996 |
| DE | 195 16 353 A1 | 11/1996 |
| EP | 0 324 718 A1 | 7/1989 |
| EP | 0 668 824 B1 | 2/1997 |

* cited by examiner

*Primary Examiner*—Eugene Eickholt
(74) *Attorney, Agent, or Firm*—Laurence A. Greenberg; Werner H. Stemer; Ralph E. Locher

(57) ABSTRACT

A method of regulating inking when printing with a printing machine, including determining an actual color value with a color measuring device directed towards a printed material, and feeding the determined actual color value to a color control device, comparing the actual color value with a desired color value, forming an adjusted variable from the comparison value by using a mathematical model of the ink control loop, and feeding the adjusted variable to an ink setting element so that the setting element correctingly changes the inking, which comprises calculating a steady state value ($s_{stab}$) from an additive superimposition of the time changes in preceding adjusted variable changes ($\Delta y_i$), and calculating a new adjusted variable (y) from the desired color locus ($x_{des}$), the actual color value ($x_{act}$) and the steady state value ($s_{stab}$).

6 Claims, 4 Drawing Sheets

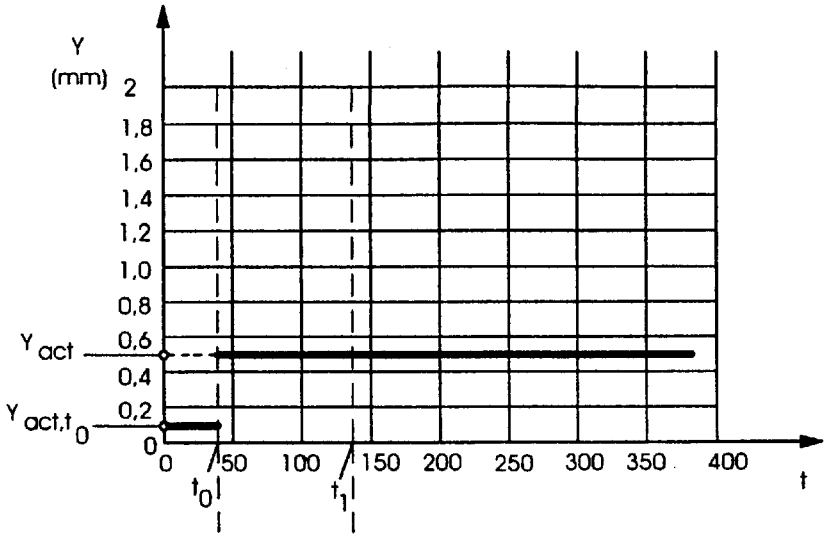
Fig.3.1
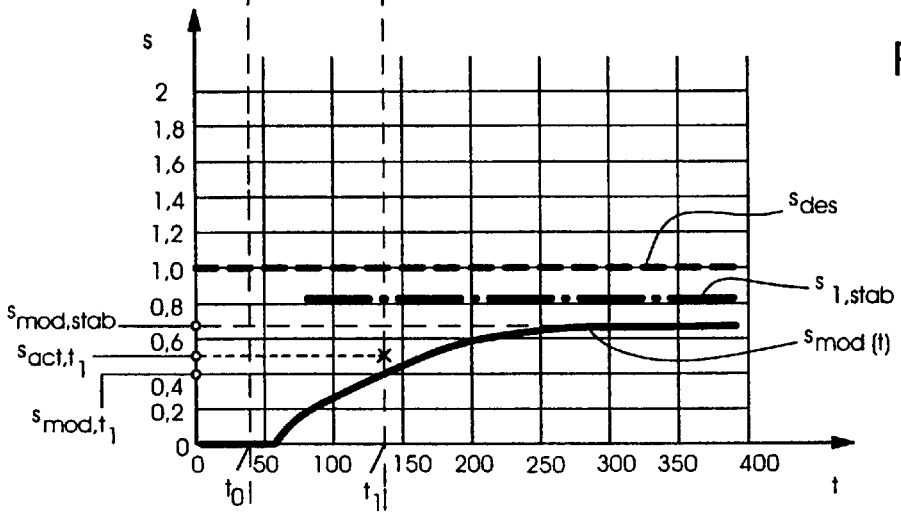
Fig.3.2
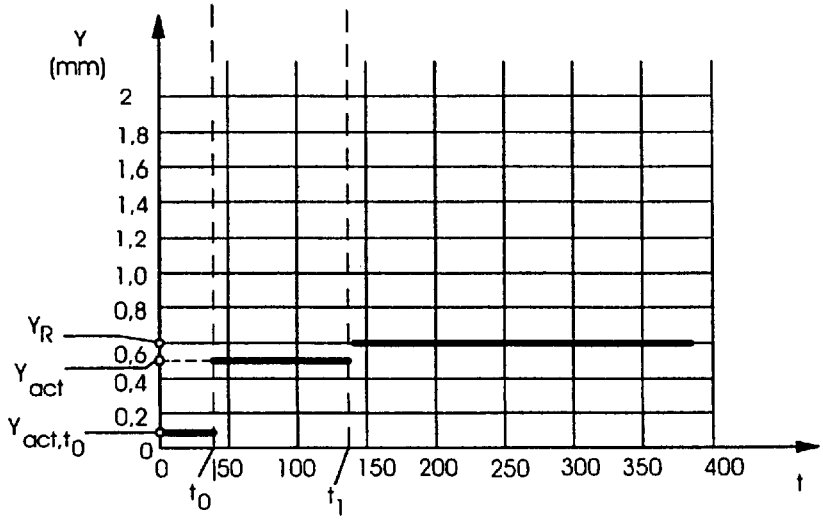
Fig.3.3

METHOD OF REGULATING INKING WHEN PRINTING WITH A PRINTING MACHINE

BACKGROUND OF THE INVENTION

Field of the Invention

The invention relates to a method of regulating inking when printing with a printing machine. When several colors are printed over one another in several printing units, respectively, it has become known to obtain actual values representing the inking with the aid of a detector that is directed towards the printed material at the output of the last printing unit. If photoelectric detectors are employed, the measurement light reflected from specific print control elements, or directly from the printed image, can be keyed in or inputted densitometrically or calorimetrically, converted into an electrical signal and fed to a color control device. From the electrical signal, by applying a mathematical algorithm, respectively, an actual value for the thickness of the printing ink layers present on the printing material can be calculated. Within the color control device, the actual values are compared with desired values. A computer can be used for processing the measured value. If the actual value for the layer thickness deviates from the desired value, a comparison value is used to form a control variable, which is fed to an actuator or adjusting element that effects a change in the layer thickness at the respective measurement location. Conventional printing machines have, for each printing ink, ink-adjusting elements which permit adjustment of a layer thickness in so-called zones transversely to the transport direction of sheets and a web, respectively. The adjustment variables output by the color control device may be varied by an operator or automatically with the aid of ink control pushbuttons assigned to the inking zones. When a change in an adjustment variable is effected by the color control device or manually, a finite time period elapses before subsequent layer thickness changes on the printing material have been completed. The color control device is so constructed that adjustments can be performed correctly only when the layer thickness has essentially reached a steady state value after preceding changes in the adjustment variable. The operator will initiate adjustments manually only when he is convinced that preceding actuating operations have essentially been completed and the printing machine system is in a stable state. In order to avoid unstable regulation with unnecessary adjustments and, if necessary or desirable, to avoid the overshooting of or exceeding the layer thicknesses, it has become known heretofore to purport a selected number of sheets during which adjustments are prevented following a previously initiated adjustment (note the published European Patent Document EP 668 824 B1).

In addition, it has become known heretofore to perform adjustments only when the difference between the actual value and the desired value exceeds a threshold value. The operator has the option of entering or inputting the threshold value, via a keyboard or the like, as a function of the subject and of the desired permissible tolerance of the inking deviations in the printed image.

In order to increase the control speed, it has become known heretofore to determine the gradient of the inking changes in the print and, without waiting for a steady state value, to perform the color control and regulation, respectively, as a function of this gradient (note the published German Patent Document DE 44 12 601 A1). A disadvantage, in this regard, is that a large number of measurements are required in order to determine the gradient sufficiently accurately.

SUMMARY OF THE INVENTION

It is accordingly an object of the invention to provide a method of regulating inking when printing with a printing machine wherein a control algorithm is developed which reduces the outlay for obtaining the measured value, avoids erroneous or faulty conditions, improves control accuracy and increases control speed.

With the foregoing and other objects in view, there is provided, in accordance with the invention, a method of regulating inking when printing with a printing machine, including determining an actual color value with a color measuring device directed towards a printed material, and feeding the determined actual color value to a color control device, comparing the actual color value with a desired color value, forming an adjusted variable from the comparison value by using a mathematical model of the ink control loop, and feeding the adjusted variable to an ink setting element so that the setting element correctingly changes the inking, which comprises calculating a steady state value ($s_{stab}$) from an additive superimposition of the time changes in preceding adjusted variable changes ($\Delta y_i$), and calculating a new adjusted variable (y) from the desired color-locus ($x_{des}$), the actual color value ($x_{act}$) and the steady state value ($s_{stab}$)

In accordance with another mode, the method invention includes continuously adapting the mathematical model for calculating the steady state value ($s_{stab}$) to current process conditions.

In accordance with a further mode, the method invention includes, at each change to the adjusted variable (y), storing in memory the consecutive number (n) of the print and the magnitude $\Delta y_i$ of the change to the adjusted variable (y), the variables (n, $\Delta y_i$) being processed in a mathematical model describing the dependence of the adjusted variables y by a mathematical relationship at the respective time $t_i$ of the change to an adjusted variable $y_i$.

In accordance with an added mode, the method invention includes introducing an adjusted variable change ($\Delta y$) by manual intervention by an operator.

In accordance with an additional mode, the method invention includes determining the actual color value ($x_{act}$) by having an operator remove a printed copy at a time ($t_i$) predefined by the operator, and measure the actual color value on a measuring device not assigned to the printing machine.

In accordance with a concomitant mode, the method invention includes determining a threshold value for the comparison value ($x_{act}-x_{des}$) as a function of the time $t_i$ of the determination of the actual color value ($x_{act}$) and of the desired color value ($x_{des}$), and enabling a change in the adjusted variable ($\Delta y_i$) only when the threshold value is exceeded.

The invention offers the advantage that not only the uncertain actual values are used during the calculation of adjusted variables, but steady state values of the variable to be controlled are calculated by using the prehistory of the actuating operations, and are used for control.

A threshold value for the comparison value, from which adjustments are to be performed, is continuously adapted to the current printing conditions, by taking into account the frequency, the duration and the magnitude of preceding actuating operations. The shorter the time interval since the last adjustment, the higher the threshold value is calculated to be. The threshold value can assume an infinite magnitude if the uncertainty of the calculated steady state final values is too high. In this case, no adjustments are permitted. In order to calculate the steady state values and the threshold values, use is made of a mathematical model of the printing machine. It has proven to be advantageous to model a printing machine as a delay element of first order with a dead time. The model of the printing machine is corrected at each measurement of the actual values. The model values are compared with the measured values, and the gain factors of the delay element are recalculated from the corresponding model data and the machine state.

When the method is employed, it is not necessary to register the actual values for the inking continuously, nor to register a large number of actual values for the inking. A single measured data set is sufficient by itself to take into account the steady state final values of the ink layer thickness on the printed material in the respective inking zones. The method can therefore be used in particular in inking machines wherein the measurements of the actual values are performed only sporadically, by sample prints being removed from the regular material flow at any desired times selected by an operator, and being measured. Furthermore, the method makes it possible to take into account the adjusted variable changes performed by the operator without requiring renewed measurements of actual values.

Other features which are considered as characteristic for the invention are set forth in the appended claims.

Although the invention is illustrated and described herein as a method of regulating inking when printing with a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 3.1, 3.2 and 3.3 are timing diagrams which describe the course of the method.

DESCRIPTION OF THE PREFERRED EMBODIMENTS

Figure 1:
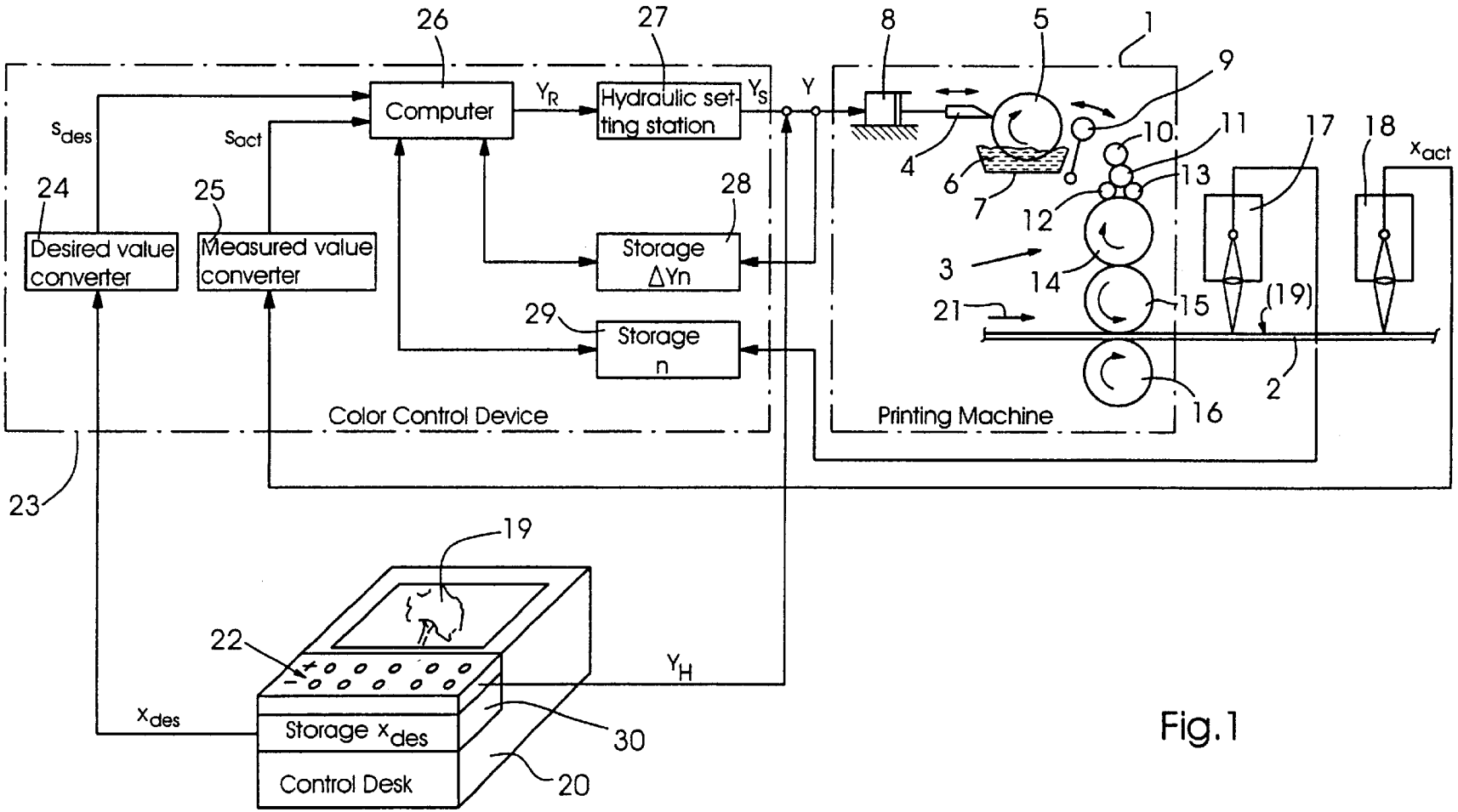
FIG. 1 is a schematic and diagrammatic view of a color control system for performing the method according to the invention.

Referring now to the drawings and, first, particularly to FIG. 1 thereof, there is shown therein, in a schematic and diagrammatic view of a color control system for performing the method according to the invention, from which the implementation of the method is explained hereinafter. An offset printing machine 1 is being used to print a web 2 in a multicolor printing process. In FIG. 1, an ink control system in a last printing unit 3 of an offset printing machine 1 is shown. An inking zone knife 4 is engageable and disengageable with the circumferential surface of an ink fountain roller 5. The ink fountain roller 5 is mounted so as to be rotatable, and dips into printing ink 6 located in an ink fountain 7. The inking zone knife 4 is positioned at right angles to the axis of rotation of the ink fountain roller 5 with the aid of an operating cylinder 8. As the ink fountain roller 5 rotates, printing ink 6 is scooped up onto the surface thereof. The thickness of the layer of printing ink 6 that is built up downline from the inking zone knife 4 depends upon the gap which exists between the inking zone knives 4 and the surface of the ink fountain roller 5. A vibrator roller 9 ensures that the printing ink 6 is transported onward from the surface of the ink fountain roller 5 to an ink transfer roller 10. The vibrator roller 9 is mounted so as to oscillate reciprocatingly. The contact time on the surface of the ink fountain roller 5, and the frequency of oscillation are controllable. The ink transfer roller 10 is in rolling contact with a further ink transfer roller 11, which is, in turn, in contact with ink applicator rollers 12 and 13. The ink transfer rollers 10 and 11 and the ink applicator rollers 12 and 13 effect the inking of a printing form that is applied to the surface of a plate cylinder 14. The printing ink 6 is then transferred from the plate cylinder 14 to the web 2 via a transfer cylinder 15. The web 2 passes through a printing nip formed between the transfer cylinder 15 and an impression cylinder 16. On a travel path of the web 2 to a wind-up reel, the web 2 is led past two photoelectric detectors 17 and 18. The detector 17 is constructed as an edge detector and is used to detect the presence of a print 19. The detector 17 includes a counter for the number n of prints 19 which are produced. The detector 18 is an image recording device, which is capable of obtaining color measured values $x_{act}$ at predetermined measurement locations in the printed image 19. In order to control the inking on the web 2, to predefine desired values $x_{des}$ and to assess a print 19 or match the colors thereof, a control desk 20 is provided. For each inking zone that can be adjusted transversely to the transport direction 21, an operator can enlarge or reduce the gap between the respective inking zone knife 4 and the surface of the ink fountain roller 5 with the aid of input pushbuttons 22. An actuating signal $y_H$ generated with the input pushbuttons 22 acts directly on the operating cylinder 8 and on the inking zone knife 4 coupled to the piston of the operating cylinder 8. The detectors 17 and 18, the control desk 20 and the operating cylinder 8 are connected to a color control device 23. Contained in the color control device 23 are a desired value converter 24, a measured value converter 25, a computer 26, a hydraulic adjusting or positioning station 27, an adjusted variable memory or storage 28, and a memory or storage 29 for the number n of prints 19 passed through, The output signal from the detector 18 is fed to the measured value converter 25. In the measured value converter 25, a color measured value $x_{act}$ is converted into an actual ink layer thickness $s_{act}$ for each of the printing inks 6 which are involved. In a similar way, the desired value converter 24 provides the conversion of a desired value $x_{des}$, entered at the control desk 20 for a specific measurement location and recorded in a memory 30, into a desired ink layer thickness $s_{des}$. The actual ink layer thickness $s_{act}$ and the desired ink layer thickness sdes are fed to the computer 26 for comparison. In addition, the computer 26 is given, as input variables, the current number n of prints 19 passed through, and the preceding adjusted variable changes $\Delta y_n$, stored in the adjusted variable storage or memory 28, with the number n of the prints 19 reached when the respective adjusted variable change $\Delta y_n$ was initiated. In order to process the comparison value between the actual ink layer thickness $s_{act}$ and the desired ink layer thickness $s_{des}$ and the abovementioned further input variables, the computer 26 has a program installed therein which is used to calculate an adjusted variable $y_R$, which is output to the hydraulic adjusting station 27, which causes the gap between the inking zone knife 4 and the surface of the ink fountain roller 5 to be adjusted via the operating cylinder 8 in accordance with the adjusted variable $y_R$. With a given delay, therefore, the layer thickness of the printing ink 6 which is printed onto the web 2 also changes. A layer thickness change in one of the printing inks 6 which are involved means a change in the coloration in the print 19, which is registered or determined by the detector 18.

Figure 2:
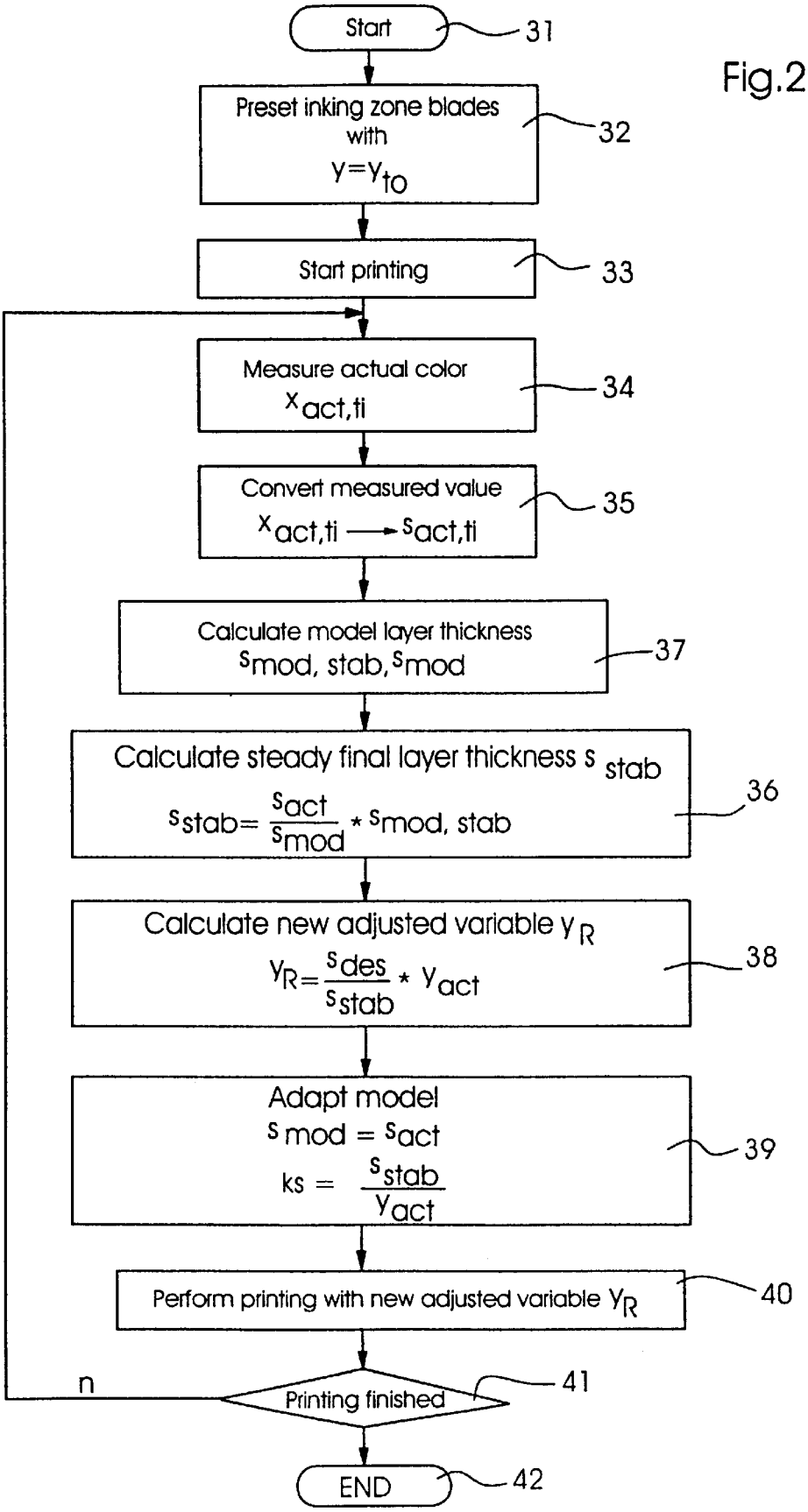
FIG. 2 is a flow diagram of a first mode of the course of the method.

With reference to FIGS. 2 and 3, there is described hereinbelow how the adjusted variable $y_R$ is determined with the aid of the computer 26. The aim of regulating the inking is so to perform adjustments to the inking zone knives 4 that the actual ink layer thickness $s_{act}$ is matched as quickly and accurately as possible to the desired ink layer thickness $s_{des}$. Assuming that the printing machine 1 is in a basic state, wherein there is still no ink in the printing unit 3, and the inking zone knives 4 are in contact with the surface of the ink fountain roller 5, then, after a starting command 31, the inking zone knives 4 are preset at a time $t_0$ in a step 32. The adjusted variables $y=t_{t0}$ used for the presetting are given for each of the inking zones from measured results from a plate scanning device, from calculations using the data reproducing the printed image or from adjusted variables $y_{H,t0}$ inserted by hand with the input pushbuttons 22. In a step 33, printing is started with this presetting. After a dead time has expired, an ink profile corresponding to the adjusted variables $y_{t0}$ is established in the printing unit on the elements carrying printing ink, which produces an actual ink layer thickness $s_{act}$ on the web 2. At an arbitrary time $t_1$ predefined by the operator of the printing machine 1, the measurement of the actual color locus $s_{act}$ for each inking zone is performed in a step 34. In a step 35, the measured values $x_{act}$ are converted into the actual ink layer thicknesses $x_{act}$ in the measured value converter 25. The conversion of the measured values $x_{act}$ into the actual ink layer thicknesses $s_{act}$ can be performed in accordance with the method described in the published European Patent Document EP 0 324 718 A1. During the conversion, account can be taken of the fact that, as a result of the ink transport in the printing unit 3 in the direction transverse to the conveying direction of the web 2, the ink metering in one zone exerts an influence upon the metering in adjacent inking zones. In a step 36, the actual ink layer thicknesses $s_{act}$ are used to calculate values $s_{stab}$ for stable final layer thicknesses in accordance with the following relationship:

$$s_{stab} = s_{act} \times \frac{s_{mod,stab}}{s_{mod}}$$

The model layer thicknesses $s_{mod,stab}$ and $s_{mod}$ are calculated from known variables in a separate step 37.

In the calculation, use is made of a mathematical model of the printing machine 1 which describes the time dependence of the actual ink layer thickness $s_{act}$ on a manipulated variable change $\Delta y$. If, in control terms, the printing machine 1 is a delay element of first order (VZ1 element) with a dead time $T_t$ and a system time constant T, then the value $s_{mod}$ is given by the following relationship:

$$s_{mod} = KS \times \sum_{i=0}^{n} \left[ \Delta y_i \times \left( 1 - e^{\frac{-(t_i - T_t)}{T}} \right) \right] + S_{mod,old}$$

KS is the gain factor of the VZ1 element. $\Delta y_i$ designates a change in the manipulated variable y at a time $t_1$. At a uniform printing speed, $t_i$ corresponds to the number n of the prints made since the change in the adjusted variable y. At the start of printing, at the time $t_0$, $\Delta y_i = y_{t0}$. $s_{mod,old}$ corresponds to the model actual layer thickness from the preceding calculation of $s_{mod}$ at the time $t_{i=1}$. At the start of printing, at the time $t_0$, $s_{mod,old}=0$ in the present example, because the assumption was a printing unit 3 not filled with printing ink. The value $s_{mod,stab}$ stands for a stable model final layer thickness and is given by:

$$s_{mod,stab} = KS \times \sum_{i=0}^{n} \Delta y_i + s_{mod,stab,old}$$

$s_{mod,stab,old}$ corresponds to the stable model final layer thickness from the preceding calculation of $s_{mod,stab}$. This value is also zero at the start of printing.

In the following step 38, the value $s_{stab}$ is used to calculate a new position for. the inking zone knives 4, by an adjusted variable $y_R$ being calculated for each inking zone knife 4 at each time $t_i$ as follows:.

$$y_R = \frac{s_{des}}{s_{stab}} \times y_{act}$$

In a further step 39, the characteristic variables KS and $s_{mod}$ are adapted for the following method passes, by $s_{mod}$ being set equal to $s_{act}$ and KS being formed from:

$$KS = \frac{s_{stab}}{y_{act}}$$

In a step 40, the new manipulated variables $y_R$ calculated in step 38 are output to the inking zone knives 4 via the setting station 27. If it is determined in step 41 that the scheduled number n of prints has been produced, then the method comes to an end in step 42. Otherwise, the method is continued with step 34, by new actual color loci $x_{act,ti}$ being measured.

FIGS. 3.1 to 3.3 show timing diagrams with the curves of $y_R$ (t) and s (t). The number of sheets printed is plotted on the time axes. As shown in FIG. 3.1, the ink knife position is changed abruptly in one inking zone at a time $t_0$. At a time $t_1$, the detector 18 is used to derive a measured value $s_{act}$ for the actual ink layer thickness. The adjusted variable change performed at the time to has the effect of a change in the ink layer thickness s which, at the time $t_1$ has still not reached the stable end value $s_{mod,stab}$. FIG. 3.2 shows the model layer thickness $s_{mod}$ (t) resulting from the adjusted variable change, the desired layer thickness $s_{des}$, the stable model final layer thickness $s_{mod,stab}$, the measured value $s_{act}$ of the layer thickness at the time $t_1$ and the real stable final layer thickness $s_{1,stab}$ to be expected. FIG. 3.2 reveals that if $s_{act}$ is used without taking into account the prehistory, an excessively high control deviation ($s_{des}-s_{act}$) occurs, which would result in excessive coloration in the relevant inking zone; if the prehistory and the current measured value $s_{act}$ are taken into account, then the result is the control deviation of $s_{des}-s_{1,stab}$. The adjusted variable change turns out to be considerably lower. Overshooting is avoided (FIG. 3.3).

According to the course of the method described hereinabove, at each adjustment to the inking zone knives 4, the corresponding adjusted variables y and the number n of prints reached when the adjustment operation was initiated are stored and taken into account when calculating the new ink knife positions. This makes it possible to derive adjusted variables $y_R$ from only very few measured values relating to the actual color loci $x_{act}$, without undesired control deviations or control time delays occurring. The method is therefore particularly suitable for printing machines wherein the measurement of the actual values of the inking is performed sporadically by an operator on a separate measuring desk.

Figure 4:
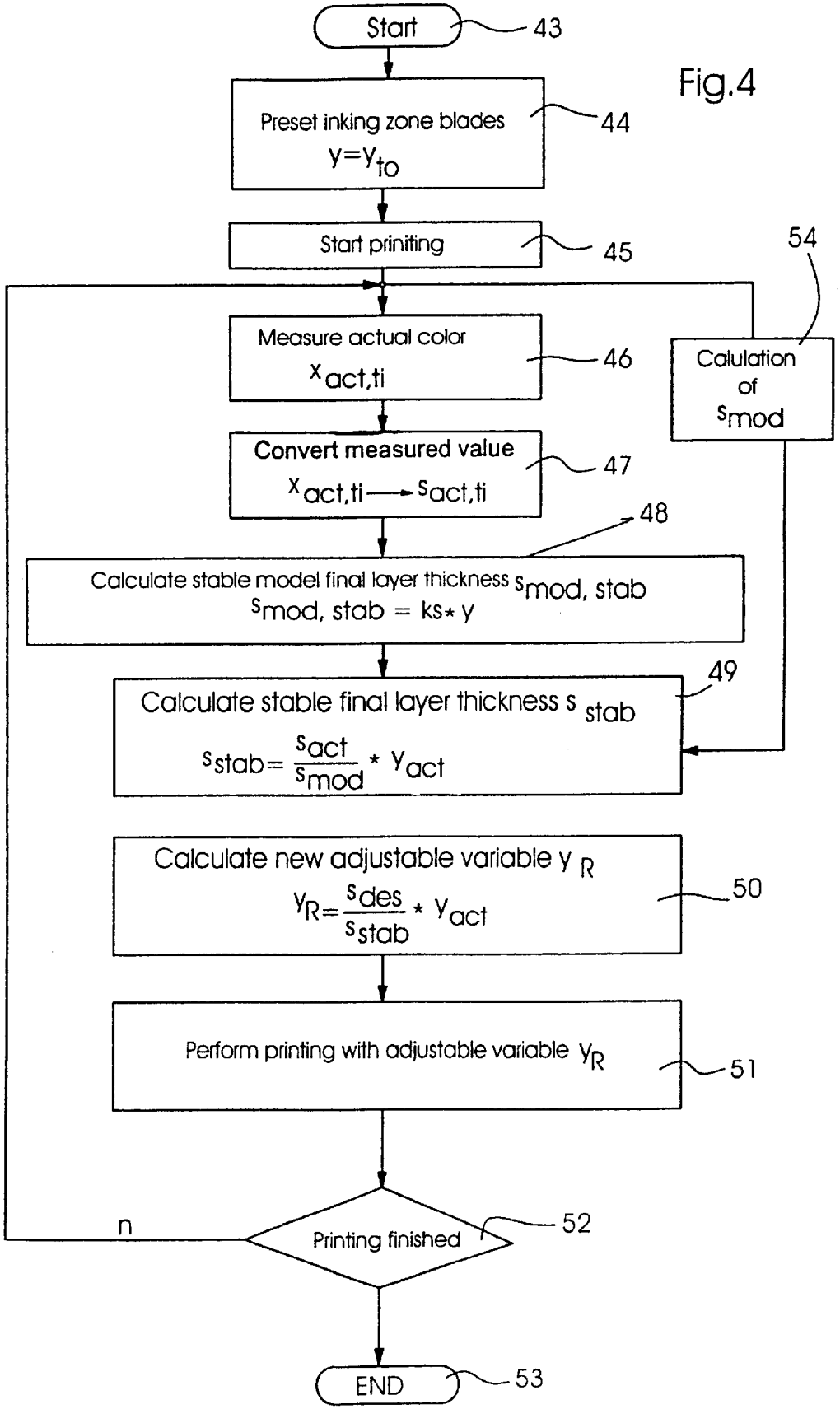
FIG. 4 shows a flow diagram of a second mode of the course of the method according to the invention.

In the different modes described hereinbelow, the storage of the changes $\Delta y_R$ to the adjusted variables $y_R$ is dispensed with. Steps 43 to 46 shown in FIG. 4 correspond to the steps 31 to 33 described in relation to FIG. 2. In a step 54, the model layer thicknesses $s_{mod}$ are calculated at regular sample times $t_i$ or, given a uniform printing speed, at a permanently predefined number n of prints.

In a step 47, the actual layer thickness $s_{act,ti}$ is derived from the actual color locus $x_{act,ti}$ which was determined at the time $t_i$, using the measured value converter 25. From the gain factor KS of the printing machine 1 (modeled as a VZ1 element) and the position y of the ink knife 4 at the time $t_i$, the stable model final layer thickness $s_{mod,stab}$ is calculated in a step 48 by multiplication:

$$s_{mod,stab}=KS*y$$

In a further step 49, a value for the stable final layer thickness $s_{stab}$ is calculated from the actual layer thickness $s_{act,ti}$ derived in step 47, in accordance with the following relationship:

$$s_{stab} = \frac{s_{act}}{s_{mod}} * s_{mod,stab}$$

A new adjusted variable YR is given in the following step 50 from $$y_R = \frac{s_{des}}{s_{stab}} * y_{act}$$

In step 51, printing is continued with this adjusted variable. The method is ended when the result of the interrogation step 52 is that the scheduled number of prints has been made. Otherwise, the method is continued with step 46.

We claim:

1. A method of regulating inking of an ink film thickness when printing with a printing machine using a pre-existing mathematical model of the machine including an ink control loop and a model ink layer thickness, which comprises:

determining an actual color value ($x_{act}$) of an ink thickness with a color measuring device directed towards a printing copy;

feeding the determined actual color value ($x_{act}$) to a color control device;

comparing the actual color value ($x_{act}$) with a desired color value ($x_{des}$) and forming a comparison value ($x_{act}-x_{des}$);

forming an adjusted variable (y) from the comparison value by using the pre-existing mathematical model of the ink control loop;

feeding the adjusted variable (y) to an ink setting element so that the setting element correctingly changes the inking; and performing the step of forming the adjusted variable (y) by including:

calculating a steady state value ($s_{stab}$) of the ink film thickness by additively superimposing preceding adjusted variable changes ($\Delta y_i$); and calculating a new adjusted variable ($Y_R$) from the desired color value ($x_{des}$) , the determined actual color value ($x_{act}$), and the steady state value ($s_{stab}$).

2. The method according to claim 1, which includes continuously adapting the mathematical model for calculating the steady state value ($s_{stab}$) to current process conditions.

3. The method according to claim 1, which includes introducing an adjusted variable change ($\Delta y$) by manual intervention by an operator.

4. The method according to claim 1, which includes determining the actual color value ($x_{act}$) by having an operator remove the printed copy at a time ($t_i$) predefined by the operator, and measure the actual color value ($x_{act}$) on a measuring device not assigned to the printing machine.

5. The method according to claim 1, which includes determining a threshold value for the comparison value ($x_{act}-x_{des}$) as a function of the time $t_i$ of the determination of the actual color value ($x_{act}$) and of the desired color value ($x_{des}$), and enabling the adjusted variable changes ($\Delta y_i$) only when the threshold value is exceeded.

6. The method according to claim 1, which further comprising, at each change to the adjusted variable (Y), storing in a memory the consecutive number (n) of the printed copy and the magnitude of the change ($\Delta y_i$) to the adjusted variable (Y), the variables (n, $\Delta y_i$) being processed in a mathematical model describing the dependence of the adjusted variables by a mathematical relationship at the respective time $t_i$ of the change to an adjusted variable, which relationship is expressed as:

$$y_R = \frac{s_{des}}{s_{stab}} \times y_{act}$$

wherein $Y_{act}$ designates an actual adjusted variable y at time $t_i$, and $Y_R$ designates a new adjusted variable at time $t_i$.

* * * * *